United States Patent [19]

Richards

[11] Patent Number: 4,919,464

[45] Date of Patent: Apr. 24, 1990

[54] MAGNETICALLY OPERATED LATCH

[76] Inventor: Roger C. Richards, 8 Church Street, Amersham, Buckinghamshire, Great Britain

[21] Appl. No.: 353,178

[22] Filed: May 16, 1989

Related U.S. Application Data

[63] Continuation of Ser. No. 92,942, Sept. 4, 1987, abandoned.

[51] Int. Cl.[4] ..... E05C 17/56

[52] U.S. Cl. ..... 292/251.5; 292/201

[58] Field of Search ..... 292/251.5, 25, 194, 292/201, 204; 70/289, 413, 276; 220/230

[56] References Cited

U.S. PATENT DOCUMENTS

| | | | |
|---|---|---|---|
| 2,730,392 | 1/1956 | Thiebaud | 70/289 |
| 3,495,425 | 2/1970 | Hallmann | 70/413 |
| 3,518,855 | 7/1970 | Wake | 70/413 |
| 3,596,958 | 8/1971 | Bowerman | 403/108 |
| 3,600,019 | 8/1971 | Toyota | 292/106 |
| 3,641,793 | 2/1972 | Van Dalen | 70/276 |
| 3,744,833 | 7/1973 | Berducone | 70/276 |
| 3,785,188 | 1/1974 | Drathschmidt | 70/413 |
| 3,831,986 | 8/1974 | Kobayashi | 292/251.5 |
| 3,837,195 | 9/1974 | Pelto | 70/413 |
| 3,837,525 | 9/1974 | Kobayashi | 292/144 |
| 4,380,162 | 4/1983 | Woolfson | 70/413 |

FOREIGN PATENT DOCUMENTS

| | | | |
|---|---|---|---|
| 73446 | 8/1949 | Denmark | 70/276 |
| 1036702 | 8/1958 | Fed. Rep. of Germany | 70/413 |
| 586039 | 3/1947 | United Kingdom . | |
| 1201160 | 8/1970 | United Kingdom | 70/413 |
| 1580850 | 3/1980 | United Kingdom . | |
| 2145461 | 3/1985 | United Kingdom | 292/251.5 |

*Primary Examiner*—Gary L. Smith
*Assistant Examiner*—Eric K. Nicholson
*Attorney, Agent, or Firm*—Griffin, Branigan & Butler

[57] ABSTRACT

A magnetically operated latch includes one or two latching members, the or each member including a permanent magnet and being turnable or slidable between an engaging position and a disengaged position, and a further member of magnetically soft material which attracts the magnet(s) to displace the latching member(s) into the engaging position(s). To disengage the latching member(s) a further magnet is brought to a position in which it acts repulsively on the permanent magnet(s) by way of the further member.

8 Claims, 3 Drawing Sheets

MAGNETICALLY OPERATED LATCH

This application is a continuation of Ser. No. 092,942, filed Sept. 4, 1987, now abandoned.

BACKGROUND OF THE INVENTION

1. Field of the Invention

This invention relates to a magnetically operated latch.

2. Description of the Prior Art

U.S. Pat. No. 3,600,019 discloses a latch mechanism which is for slidable sashes and which can be locked in the latched position. The mechanism comprises a latching member which is mounted to be manually turned in a vertical plane for engagement with a keeper, a catch which is mounted to reciprocate in a path transverse to the plane and spring-biased to interengage with the latching member when the latter is engaged with the keeper, a catch release member which is mounted to reciprocate in a vertical path, and a bell-crank lever operative to retract the catch from the latching member against the action of the spring in response to upward movement of the catch release member. The latter is detained against upward movement by a first permanent magnet protruding into a bore therein from a bore in a block mounting the latching member. A second permanent magnet fixed in the inner end of the latter bore repels the first magnet into that detaining position. An actuator manually reciprocable in a vertical path can be raised to a position in which a third permanent magnet fixed thereto repels the first magnet into the bore the block against the action of the second magnet and so allows the catch release member to be raised by that same actuator to retract the catch. Subsequent lowering of the actuator allows the second magnet to repel the first magnet to against an external surface of the release member. When the latching member is returned into its latched position, the action of the spring on the bell-crank lever re-engages the catch and lowers the catch release member to enable the second magnet to repel the first magnet back into its detaining position. This mechanism is very complicated and employs three magnets, and is thus very costly.

U.S. Pat. No. 3,744,833 discloses a latch comprised of first and second permanent magnets mounted in mutually repelling relation upon a box so that the first is urged into an engaging position in which it engages in a recess in a cover of the box, and a third permanent magnet which when brought up to an outside wall of the box at a location close the first magnet, which is vertically displaceable in an open-topped cavity in the wall, overcomes the repulsion and withdraws the first magnet. Upon removal of the third magnet, the repulsion between the first magnet and the second magnet, which is fixed to the inside of the box, returns the first magnet to its engaging position. This latch uses three magnets, which are costly.

SUMMARY OF THE INVENTION

According to the present invention, there is provided a latch comprising latching means comprised of permanent magnet means and displaceable between an engaging condition and a disengaged condition, and a member of magnetic material arranged to attract said permanent magnet means and thus displace said latching means into said engaging condition, the arrangement being such that second magnet means can be brought into a position in which it acts repulsively upon said permanent magnet means to displace said latching means into said disengaged condition.

Owing to the present invention, it is possible to employ only two permanent magnets in a latch utilizing magnetic repulsion, and thereby minimize the cost thereof.

BRIEF DESCRIPTION OF THE DRAWINGS

For a better understanding of the invention and show how the same may be carried into effect, reference will now be made, by way of example, to the accompanying drawings, in which.

DESCRIPTION OF THE PREFERRED EMBODIMENTS

Figure 1:
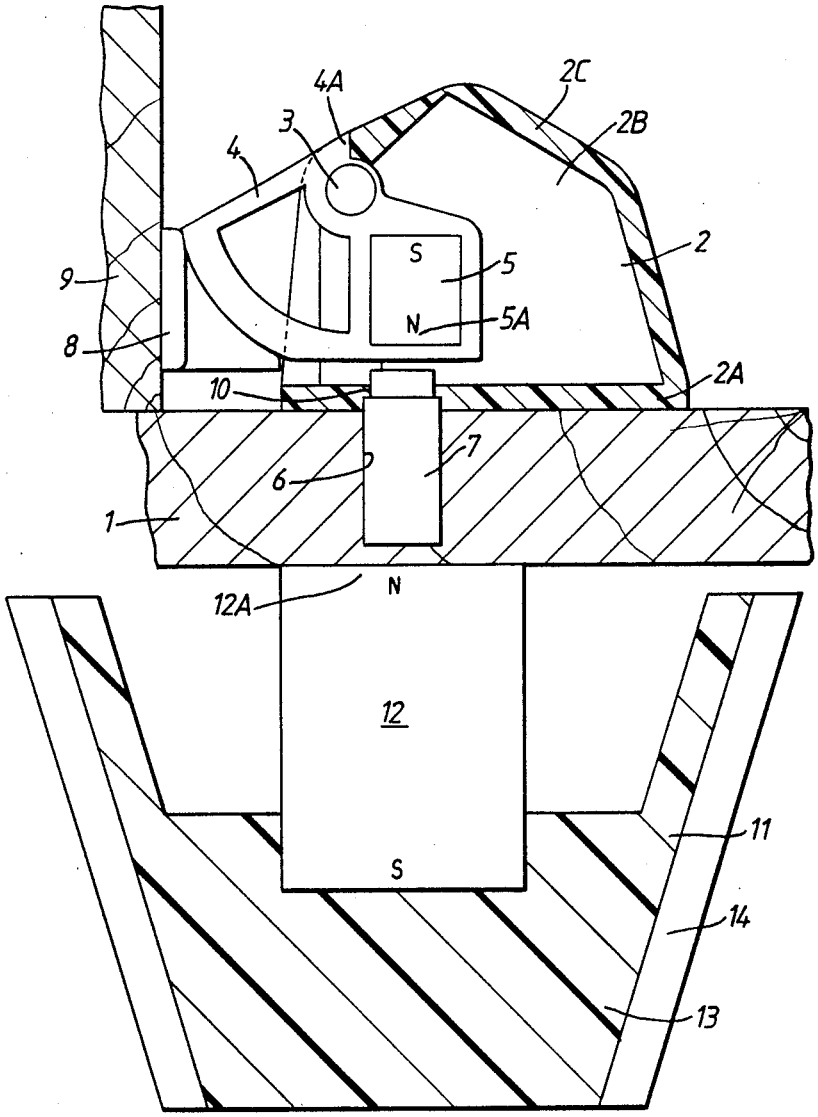
FIG. 1 shows a diagrammatic horizontal sectional view of a magnetically operated latch for latching a door leaf to a door jamb.

FIG. 1 shows a magnetically operated latch designed to be fixed to door leaves of, for example, articles of furniture. The latch is shown attached to a door leaf 1 and includes a body 2 secured by screws to the door leaf 1. The body 2 houses an extendable latching member 4 that is turnable within the body 2 about a vertical axis 3 so as to be able to extend from (as shown) or be withdrawn into the body 2.

The member 4 fixedly carries at one end a driving member 5 in the form of a permanent magnet and can releasably engage with its other end against an abutment 8 fixed to the door jamb 9. The body 2 comprises a vertical base wall 2A, two horizontal side walls (of which one is seen and referenced 2B) and a vertical shielding wall 2C. The member 4 is turnably mounted with plain bearings in the respective walls 2B and is formed with a detent 4A for abutting against the wall 2C to limit the degree of turning of the member 4 clockwise about the axis 3 in its latching position shown. Fitted co-axially in a drilled bore 6 in the leaf 1 is a rod 7 of magnetically soft material, in this case mild steel, shouldered at its inner end to fit into a shouldered bore 10 in the wall 2A. One pole 5A of the member 5 is arranged face-to-face with that inner end at a spacing therefrom and urges the member 4 into its latching position shown. A magnetic key 11 in the form of a permanent magnet 12 mounted in a plastics handle 13 formed with fluting 14 for gripping by the user's fingers and thumb has its exposed pole 12A of the same polarity as the pole 5A. Therefore, when the magnetic key 11 is applied in the vicinity of the rod 7 as shown, on the outside of the door leaf 1, the member 5 is magnetically repelled away from the magnetic key 11 and this turns the member 4 anticlockwise until it is withdrawn into the body 2. The magnetic attraction between the rod 7 and the magnet 12 is sufficient to enable the key 11 to remain adhered to the door leaf, while the leaf is opened using a handle (not shown).

When the magnetic key 11 is removed from the vicinity of the rod 7, the member 5 will be attracted back towards the rod 7, thereby returning the latch to the latching condition shown.

Apart from the two magnets illustrated and the rod 7, all other parts of the latch are made of nonmagnetic material (aluminum, brass, plastics material etc.,).

The magnetic key 11 is designed so that the pole 12A is the more naturally applied to the door leaf by the user.

Figure 2:
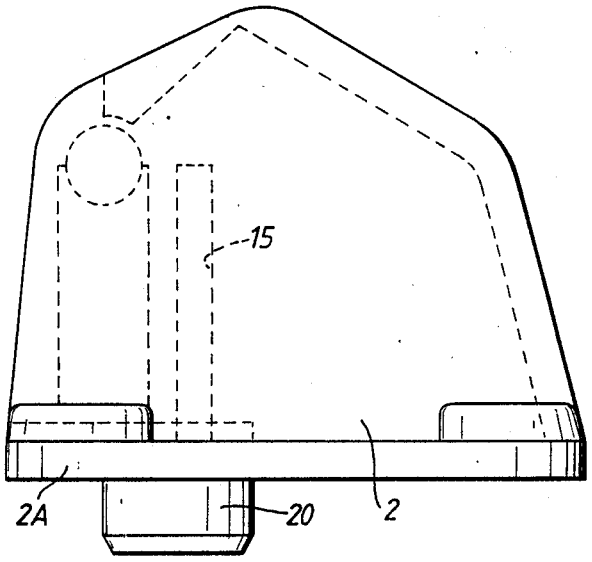
FIG. 2 shows a plan view of a body of a modified version of the latch.
Figure 3:
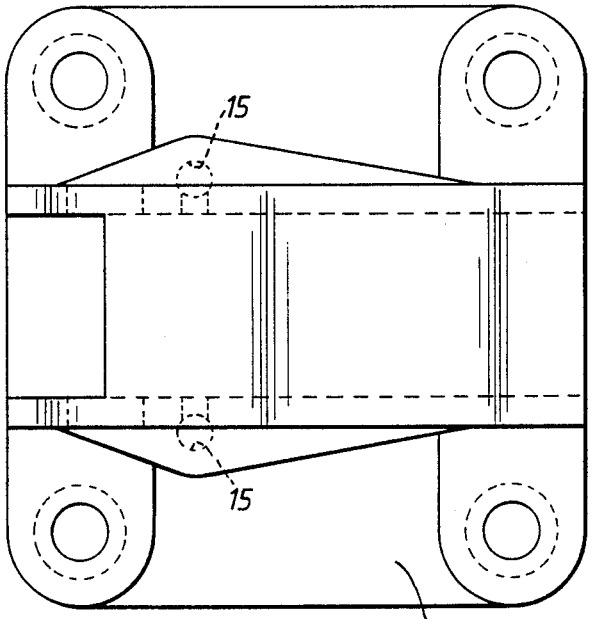
FIG. 3 shows a rear elevation of that body.

The version shown in FIGS. 2 and 3 differs from that shown in FIG. 1 in that the horizontal walls (2B) are formed with respective horizontal bores 15 which fittingly receive respective rods of magnetically soft material which extend from the inner end zone of the rod 7 along respective opposite sides of the magnet 5, in order to reinforce the magnetic repulsion and attraction effects on the magnet 5. Moreover, the body 2 further comprises a bush 20 encircling the rod 7 and projecting outwardly from the base wall 2A.

Figure 4:
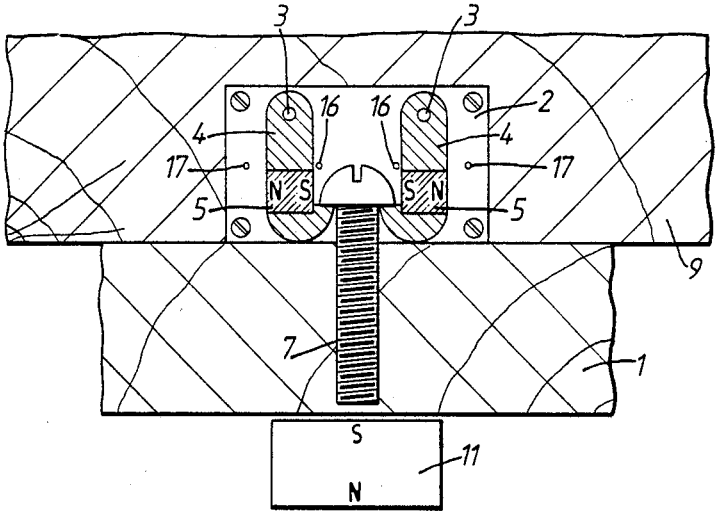
FIG. 4 is a view similar to FIG. 1 of another modified version of the latch.

In the version shown in FIG. 4, there are two latching members 4 each of hook form and turnable about respective vertical axes within limits set by stops 16 and 17 on a body 2 which, in this case, is fixed in a recess in the jamb 9. The hooked ends of the members 4 are of non-magnetic material and are arranged to engage behind the head of a magnetically soft member 7 in the form of a screw. The members 4 include respective permanent magnets 5 which are attracted towards the member 7, except when the magnet 11 is appropriately applied to the leaf 1 to repel the magnets 5 and thus turn the members 4 out of engagement with the screw 7 to allow the leaf 1 to be opened. Near the end of closing of the leaf 1, with the magnet 11 absent, the head of the screw 7 pushes aside the hooked ends of the member 4, which hooked ends then engage behind the head.

Figure 5:
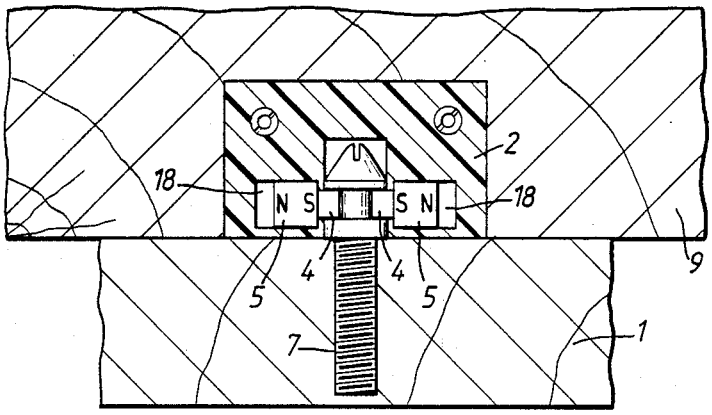
FIG. 5 is a view similar to FIG. 1 of a further modified version of the latch.

The version shown in FIG. 5 differs from that shown in FIG. 4 in that the members 4 including the magnets 5 are linearly guided in horizontal bores in the body 2, which is resiliently mounted in the jamb 9 to cope with tolerances desired during fitting of the latch to the leaf 1 and the jamb 9. Each member 4 engages in a recess in the side of the head of the screw 7 screwed into the leaf 1.

Figure 6:
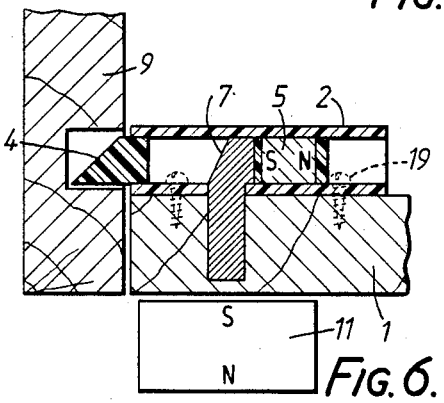
FIG. 6 is a view similar to FIG. 1 of a yet further modified version of the latch.
Figure 7:
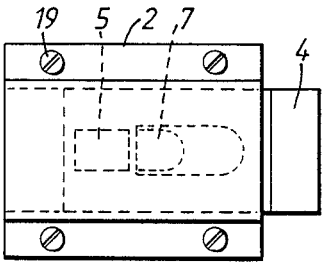
FIG. 7 is a rear view similar to FIG. 6 of that yet further modified version.

The version shown in FIGS. 6 and 7 differs from that shown in FIG. 1 chiefly in that the latching member 4 is linearly guided slidingly in the body 2, which is attached by screws 19 to the leaf 1. The magnet 5 is again separated from the member 7 by nonmagnetic material of the member 4.

It will be appreciated that the present latch provides a child proof safety lock in the kitchen and throughout the house on such furniture as would be defaced if a conventional lock with key hole etc., were fitted. In addition, the latch is useful wherever it is necessary to conceal the whereabouts of a locked leaf, such as a ceiling panel or a door, the magnetic key only remaining adhering to the outside of the leaf for as long as it is required to keep the leaf unlatched.

I claim:

1. A latch comprising:

(1) an abutment for latching said latch;

(2) a pivotable latching means for latching engagement with said abutment, said latching means having an abutment engaging portion and a first permanent magnet;

(3) pivot means for pivotally mounting said latching means to a support therefor, wherein said engaging portion and said first permanent magnet are pivotable about said pivot means between a latched position where said engaging portion engages said abutment and an unlatched position where said engaging portion does not engage the abutment;

(4) magnetic material means disposed adjacent to said latching means and in a position wherein the said latching means is pivotable about said pivot means so that said first permanent magnet is attracted to said magnetic material means and placed in juxtaposition therewith, whereby the said engaging portion is maintained only in said latched position;

and further comprising a second magnet wherein the disposition of said first permanent magnet in said latching means is in relation to said engaging portion and said pivot means such that said second magnet is positionable to act repulsively upon said first permanent magnet to pivot said latching means to said unlatched condition and wherein in the absence of said second magnet the latching means is only in the said latched condition.

2. A latch according to claim 1, wherein said magnetic material means consists of magnetically soft material and serves to transmit the repulsive magnetic flux of said second magnet towards said first permanent magnet.

3. A latch according to claim 2 and further comprising a body in which said latching means is pivotally mounted and which includes a base wall through which said magnetic material means extends.

4. A latch according to claim 3, wherein said body further comprises a bush encircling said magnetic material means and projecting outwardly from said base wall.

5. A latch according to claim 1, and further comprising non-magnetic portions interposed between said first permanent magnet and said magnetic material means to prevent said first permanent magnet from contacting said magnetic material means.

6. A latch according to claim 1, wherein said latching means is in the form of a lever having said abutment-engaging portion at one end zone thereof, said first permanent magnet at an opposite end zone thereof, and said pivot means intermediate said one end zone and said opposite end zone.

7. A latch according to claim 3, wherein said body further comprises two side walls which are substantially parallel to each other and substantially perpendicular to said base wall and between which said latching means is pivotally mounted for turning about said axis which is substantially perpendicular to said side walls, and a shielding wall which is spaced from said base wall and which limits turning of said latching means in said engaging condition.

8. A latch according to claim 1, and further comprising first and second additional magnetic material means extending from zones of the said magnetic material means along respective opposite sides of the said first permanent magnet in order to reinforce the magnetic effect of the said magnetic material means upon the said first permanent magnet.

* * * * *